US008915303B2

(12) United States Patent
Chalifoux

(10) Patent No.: US 8,915,303 B2
(45) Date of Patent: Dec. 23, 2014

(54) METHOD AND APPARATUS FOR INSTALLING AND REMOVING AN ELECTRIC SUBMERSIBLE PUMP

(75) Inventor: Gerald Chalifoux, Sherwood Park (CA)

(73) Assignee: Petrospec Engineering Ltd., Edmonton (CA)

( * ) Notice: Subject to any disclaimer, the term of this patent is extended or adjusted under 35 U.S.C. 154(b) by 237 days.

(21) Appl. No.: 12/877,940

(22) Filed: Sep. 8, 2010

(65) Prior Publication Data

US 2011/0308816 A1 Dec. 22, 2011

(30) Foreign Application Priority Data

Jun. 22, 2010 (CA) ..... 2707059

(51) Int. Cl.
*E21B 23/00* (2006.01)
*E21B 33/068* (2006.01)

(52) U.S. Cl.
CPC ..... *E21B 33/068* (2013.01)
USPC ..... 166/381; 166/377; 166/77.2; 166/380; 166/386

(58) Field of Classification Search
USPC ..... 166/377, 77.2, 85.1, 85.4, 380, 386, 166/381
See application file for complete search history.

(56) References Cited

U.S. PATENT DOCUMENTS

| | | | | |
|---|---|---|---|---|
| 4,498,537 | A | 2/1985 | Cook | |
| 5,146,982 | A | 9/1992 | Dinkins | |
| 5,269,377 | A | 12/1993 | Martin | |
| 5,348,094 | A | 9/1994 | Cholet | |
| 5,375,656 | A | 12/1994 | Wilson | |
| 5,544,706 | A | 8/1996 | Reed | |
| 6,017,198 | A | 1/2000 | Traylor | |
| 6,257,334 | B1 | 7/2001 | Cyr | |
| 6,328,111 | B1 * | 12/2001 | Bearden et al. | 166/381 |
| 6,557,642 | B2 | 5/2003 | Head | |
| 6,644,400 | B2 | 11/2003 | Irwin, Jr. | |
| 6,662,872 | B2 | 12/2003 | Gutek | |
| 6,857,486 | B2 | 2/2005 | Chitwood | |
| 7,299,879 | B2 | 11/2007 | Irwin, Jr. | |
| 2004/0188096 | A1 * | 9/2004 | Traylor | 166/369 |
| 2004/0211569 | A1 | 10/2004 | Vinegar | |
| 2006/0060357 | A1 | 3/2006 | Kelly | |
| 2008/0078560 | A1 * | 4/2008 | Hall | 166/387 |
| 2011/0300008 | A1 | 12/2011 | Fielder | |

FOREIGN PATENT DOCUMENTS

GB 2 359 317 A 8/2001

OTHER PUBLICATIONS

Combined Search and Examination Report Under Sections 17 & 18(3) mailed Nov. 7, 2012, in corresponding United Kingdom Application No. GB1218096.4, filed Oct. 9, 2012, 2 pages.

* cited by examiner

*Primary Examiner* — David Andrews
*Assistant Examiner* — Taras P Bemko
(74) *Attorney, Agent, or Firm* — Christensen O'Connor Johnson Kindness PLLC

(57) ABSTRACT

A method of servicing an electric submersible pump in a well with a positive wellhead pressure includes providing production tubing in the well casing, a coil tubing string within the production tubing having an electric submersible pump at a downhole end of the coil tubing string, and a pump-receiving housing above the injection port of the wellhead. With the injection port sealed and the pump-receiving housing opened, the electric submersible pump may be inserted or removed from the pump-receiving housing. With the pump-receiving housing closed and the injection port opened, the electric submersible pump may be moved to or from the production tubing in the well.

22 Claims, 3 Drawing Sheets

METHOD AND APPARATUS FOR INSTALLING AND REMOVING AN ELECTRIC SUBMERSIBLE PUMP

FIELD

This relates to a method of installing or removing an electric submersible pump (ESP) in a well with a positive well head pressure.

BACKGROUND

In wells with a positive well head pressure, such as SAGD (steam assisted gravity drainage) wells, the well must be depressurized, generally by cooling the well, in order to install or remove the ESP. The process to cool the well and reheat the well afterward adds a number of days onto the servicing of the well.

SUMMARY

According to an aspect, there is provided a method of servicing an electric submersible pump in a well with a positive well head pressure. The well comprises a casing and a wellhead mounted to the casing. The wellhead has a sealable injection port and at least one production port. The method comprises the steps of providing: production tubing in the casing connected to the wellhead such that production fluids flow through the production tubing and out the at least one production port of the wellhead; a coil tubing string having an electric submersible pump at a downhole end of the coil tubing string and control lines through the coil tubing string for controlling the electric submersible pump; and a pump-receiving housing above the injection port of the wellhead, the pump-receiving housing being sealed to atmosphere when the injection port is open, and openable to atmosphere when the injection port is sealed. The injection port is sealed and the pump-receiving housing is opened to insert or remove the electric submersible pump from the pump-receiving housing. The pump-receiving housing is closed and the injection port is opened to move the electric submersible pump to or from the production tubing in the well. The electric submersible pump may be an inverted electric submersible pump whereby the motor and customized components to attach the motor to the coiled tubing is at the top of the assembly, and the pump is at the bottom of the assembly. The control lines may comprise an oil feed line for continuously providing the electric submersible pump with clean oil and to maintain a positive pressure relative to the well pressure at the ESP location.

According to another aspect, there is provided a method of removing an electric submersible pump from the well. The method comprises the steps of providing production tubing in the casing connected to the wellhead such that production fluids flow through the production tubing and out the at least one production port of the wellhead; a coil tubing string positioned through the injection port and the production tubing, the coil tubing string having an electric submersible pump at a downhole end of the coil tubing string and control lines through the coil tubing string for controlling the electric submersible pump, the electric submersible pump being sized to pass through the production tubing; and a pump-receiving housing above the injection port of the wellhead, the pump-receiving housing being sealed to atmosphere when the injection port is open, and openable to atmosphere when the injection port is sealed. The coil tubing is retracted from the well such that the electric submersible pump is withdrawn through the injection port and into the pump-receiving housing. The injection port is sealed and the pump-receiving housing is opened to atmosphere. The electric submersible pump is removed from the pump-receiving housing.

According to another aspect, there is provided a method of inserting an electric submersible pump in the well. The method comprising the steps of providing production tubing in the casing connected to the wellhead such that production fluids flow through the production tubing and out the a least one production port of the wellhead; a coil tubing string having an electric submersible pump at a downhole end of the coil tubing string and control lines through the coil tubing string for controlling the electric submersible pump, the electric submersible pump being sized to pass through the production tubing; and a pump-receiving housing above the injection port of the wellhead, the pump-receiving housing being sealed to atmosphere when the injection port is open, and openable to atmosphere when the injection port is sealed. With the injection port sealed, the electric submersible pump is positioned in the pump-receiving housing. The pump-receiving housing is sealed to atmosphere, and the injection port is opened. The coil tubing and the electric submersible pump is lowered into the production tubing in the well with a positive well head pressure through the injection port of the wellhead and is seated into a pressure sealing seat located at the down hole end of the tubing.

According to another aspect, there is provided, in combination, a coil tubing string and an inverted electric submersible pump (ESP). The coil tubing string comprises an internal bore and control lines housed within the internal bore. The control lines extend from the surface end to the pump connection end, An oil supply supplies oil to the inverted ESP through at least one control line at a pressure greater than the pressure of a wellbore. The inverted ESP is sized to fit within production tubing and comprises a pump section and a motor section. The motor section is disposed above the pump section. The pump section comprises at least one inlet port and at least one outlet port. A coil tubing connection sealably connects the motor section to the coil tubing string. A seat engagement seal is provided on the pump section between the at least one inlet port and the at least one outlet port. The seat engagement seal engages a downhole end of the production tubing, such that the inlet ports are in communication with wellbore fluids, and the outlet ports are in communication with an interior of the production tubing.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
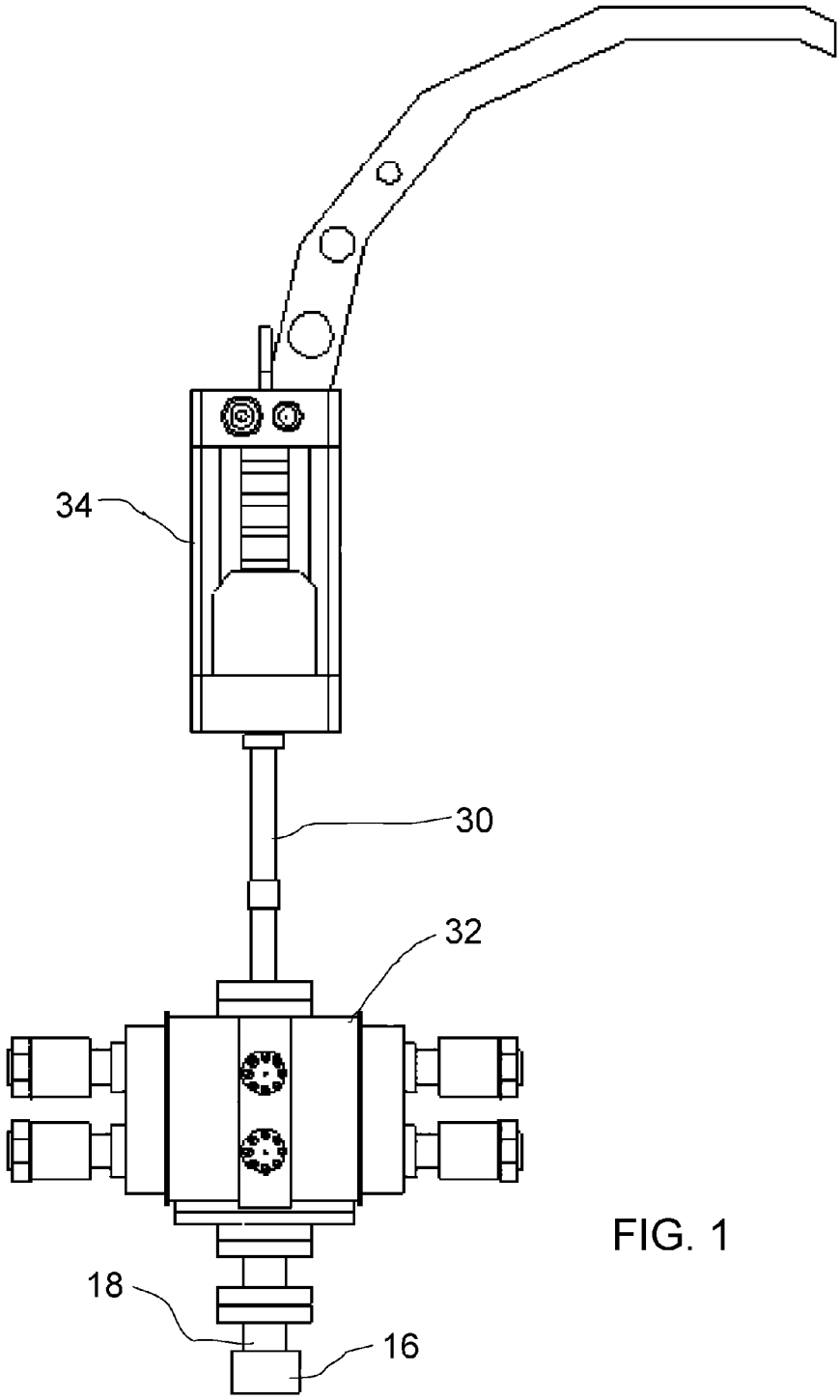
FIG. 1 is a side elevation view of the apparatus for servicing an electric submersible pump.

A method of servicing an electric submersible pump in a well with a positive well head pressure will now be described with reference to FIGS. 1 and 2.

The method described below may be used to install or remove an electric submersible pump 10 without having to cool or depressurize the well. This method may be particularly useful for thermal stimulated wells such as SAGD wells or other wells with a positive well head pressure, or other wells with a positive well head pressure that are required to be pressure relieved prior to being opened. Referring to FIG. 2, pressurized well 12 includes a casing 14 and a wellhead 16 mounted to casing 14. Wellhead 16 has a sealable injection port 18, and production ports 20. Referring to FIG. 1, injection port 18 may be sealed by a BOP 32 (blow out preventer) as shown, or it may also be sealed by a valve, a plug, etc, which may be above or below the actual port 18. Referring again to FIG. 2, the number of production ports 20 may vary depending upon the design of wellhead 16. Production tubing 22 is positioned in casing 14 and is connected to wellhead 16. Production fluids that are pumped upward by electric submersible pump 10 flow through production tubing 22 and out production ports 20 of wellhead 16. Electric submersible pump 10 is carried by a coil tubing string 24 at a downhole end 26 of coil tubing string 24, and is sized such that it is able to be run through production tubing 22. Supply lines 28, which may be instrumentation lines, control lines, or electrical or fluid delivery lines, are preferably all run through and enclosed within coil tubing string 24 and connect to electric submersible pump 10. Supply lines 28 may include power, communication lines for providing control signals, and oil feed lines that continuously provide clean oil to the electric submersible pump 10 and maintain a positive pressure relative to the well pressure at the ESP location. Preferably, fluids provided through supply lines 28 will be fed using positive displacement pumps at ground surface. Also preferably, electric submersible pump 10 is designed such that clean oil is constantly pumped through from surface, which prevents any unnecessary wear from dirty oil, and also helps create a positive seal against downhole contaminants. This may be done through a capillary tube, such as a metal capillary tube that can provide structural support to other supply lines 28, such as power or signal lines. A pump-receiving housing 30, shown in FIG. 1, is located above injection port 18 of wellhead 16. The height of pump receiving housing 30 will depend upon the size of electric submersible pump 10. Pump-receiving housing 30 is designed such that is may be sealed to the atmosphere when injection port 18 is open, and openable to the atmosphere when injection port 18 is sealed. In other words, housing 30 works with injection port 18 to ensure that well 12 is always sealed when it is pressurized. Referring to FIG. 1, a blow out preventer 32 is located above wellhead 16 and below pump-receiving housing 30. Coil tubing injector 34 is located above pump-receiving housing 30 and, referring to FIG. 2, is used to control the position of coil tubing string 24 and electric submersible pump 10 in well 12.

With the elements described above, electric submersible pump 10 may be installed or removed without having to cool well 12. In order to insert electric submersible pump 10 into a well with a positive well head pressure, injection port 18 is first sealed by closing BOP 32 and pump-receiving housing 30 is opened. Electric submersible pump 10 is connected to coil tubing string 24 and inserted into housing 30. Pump-receiving housing 30 is then closed and sealed to atmosphere and BOP 32 is opened to allow electric submersible pump 10 to be inserted through injection port 18 in wellhead 16 and into well 12 by operating coil tubing injector 34. In order to remove electric submersible pump 10 from pressurized well 10, the process is reversed, with coil tubing injector 34 lifting electric submersible pump 10 through wellhead 16 and into housing 30. BOP 32 is then closed and sealed, and housing 30 is opened to provide access to electric submersible pump 10. Electric submersible pump 10 may then be serviced or replaced, as necessary.

As depicted, electric submersible pump 10 is preferably an inverted electric submersible pump, and is run off a 1¼"-3½" coil tubing string 24 that contains the instrumentation lines. Other sizes may also be used, depending on the preferences of the user and the requirements of the well. When compared with traditional electric submersible pumps, electric submersible pump 10 lacks the seal section, motor pothead and wellhead feedthrough. As shown, electric submersible pump 10 includes a power head 27, motor section 38, thrust chamber 40, electric submersible pressure sealing seat 42 and electric submersible pump section 44. Thrust chamber 40 includes two mechanical seals with a check valve (not shown), and replaces the conventional seal/protector section that separates pump section 44 and motor section 38. The check valve in thrust chamber 40 allows the lubricating fluid supplied by supply line 28 to exit thrust chamber 40 and comingle with, for example, produced fluids from the well with the pump discharge from outlet ports 50. Pressure sealing seat 42, commonly referred to in industry as a pump seating nipple, has a seal 46 between inlet ports 48 and outlet ports 50. Inlet ports 48 are in communication with downhole fluids to be pumped to surface via outlet ports 50, which are positioned within production tubing 22.

Figure 2:
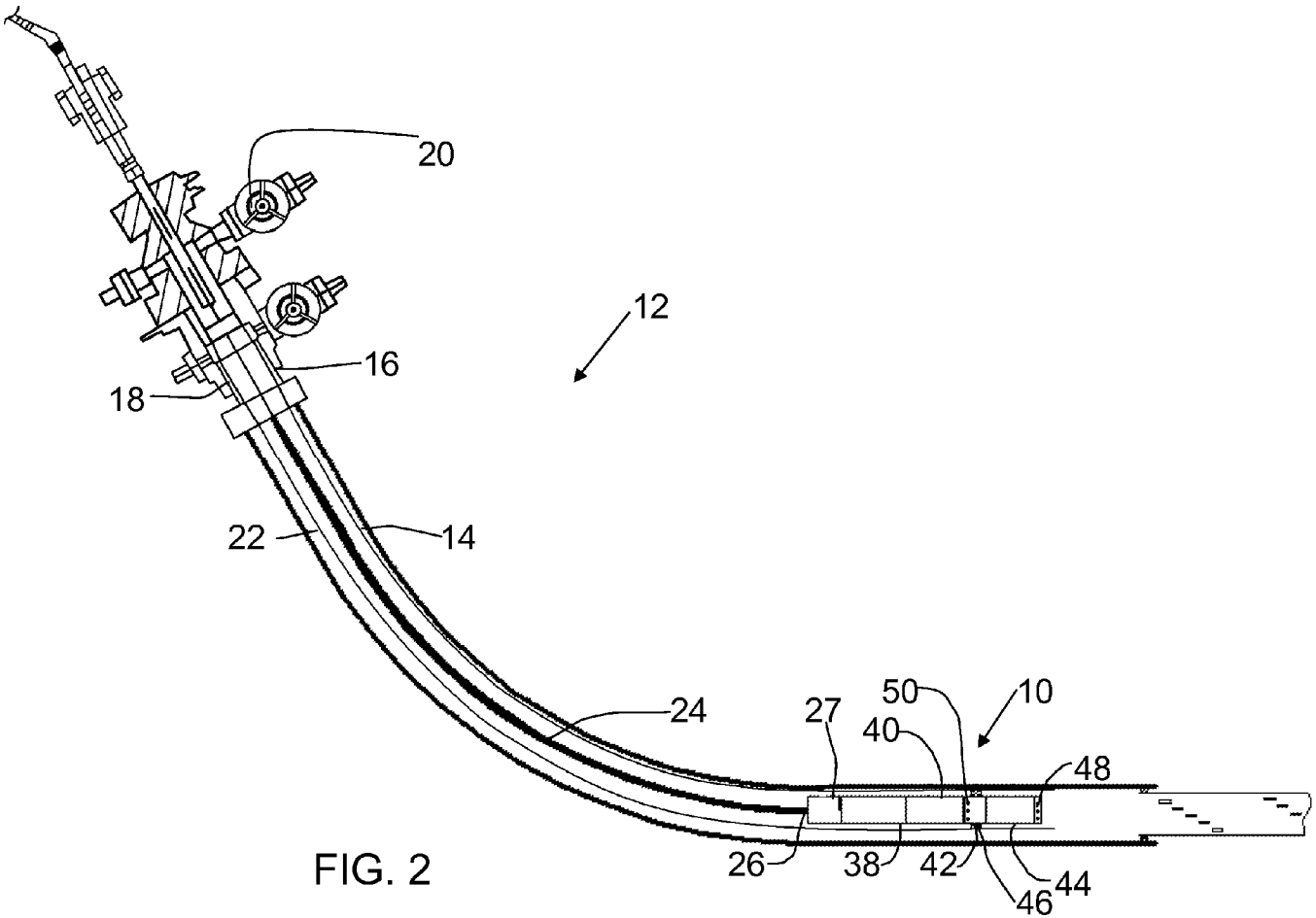
FIG. 2 is a side elevation view of the well completion with the electric submersible pump.
Figure 3:
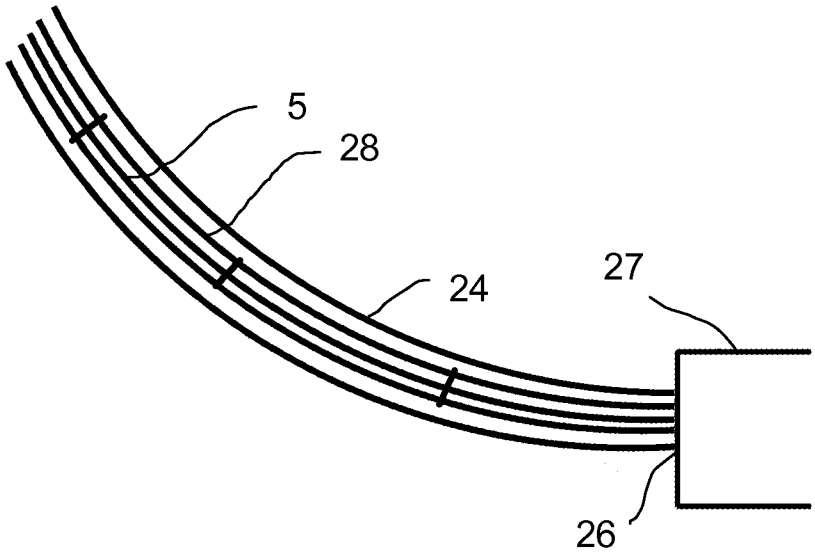
FIG. 3 is a detailed side elevation view in section of the coiled tubing string.

Referring to FIGS. 2 and 3, the motor oil delivery system comprises a surface mounted pumping and control unit that maintains a very constant flow of oil through the stainless steel capillary tubing 5 of FIG. 3 and into the motor section 38 and thrust chamber 40 of FIG. 2 regardless of the pump discharge pressure. In this way, the internal pressure of the capillary tubing 5 of FIG. 3 and the motor section 38 and thrust chamber 40 of FIG. 2 is maintained at a pressure that is 10 psi to 50 psi higher than the bottom hole pressure at the pump discharge. This will ensure that no bottom hole fluids shall enter and contaminate the motor section 38 or thrust chamber 40.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A method of servicing an electric submersible pump in a well having a positive wellhead pressure, the well comprising a casing and a wellhead mounted to the casing, the wellhead having a sealable injection port and at least one production port, the method comprising the steps of:

providing:

a production path in the casing such that production fluids flow up the production path;

a coiled tubing string having an electric submersible pump at a downhole end of the coiled tubing string and at least one supply line through the coiled tubing string connected to the electric submersible pump, the electric submersible pump comprising a pump section, a motor section, and a thrust chamber; and a pump-receiving housing above the wellhead and the injection port and seal of the wellhead, the pump-receiving housing being separate and distinct from the seal, the pump-receiving housing being large enough to receive the electric submersible pump, the pump-receiving housing being sealed to atmosphere when the injection port is open, and openable to atmosphere when the injection port is sealed;

sealing the pump receiving housing simultaneously above and below the electric submersible pump when the electric submersible pump is received within the pump-receiving housing;

sealing the injection port by closing the seal and opening the pump-receiving housing to atmosphere to insert or remove the electric submersible pump from the pump-receiving housing; and with the pump-receiving housing closed to atmosphere and the injection port open, moving the electric submersible pump using a coiled tubing injector to the production path in the well from a position fully received within the pump-receiving housing or from the production path in the well to a position fully received within the pump-receiving housing.

2. The method of claim 1, wherein the electric submersible pump is an inverted electric submersible pump having the pump section located at a bottom end of the electric submersible pump and the motor section located at a top end of the electric submersible pump.

3. The method of claim 2, wherein the pump section has inlet ports and outlet ports on an outer surface of the pump, the pump section engaging a pressure sealing seat, the pressure sealing seat sealing directly against the pump section between the inlet ports and the outlet ports such that the outlet ports are sealed within the production path and the inlet ports are sealed downhole of the production path.

4. The method of claim 1, wherein the at least one supply line comprises at least one of an oil delivery line for continuously supplying the electric submersible pump with clean oil and maintaining an internal positive pressure to the electric submersible pump, an electric power line, and a temperature and pressure data acquisition and transmission line.

5. The method of claim 4, wherein the thrust chamber separates the motor section and the pump section, the thrust chamber comprising mechanical seals, the clean oil supplied by the at least one supply line being ejected from the electric submersible pump via the thrust chamber.

6. The method of claim 4, wherein the oil delivery line is a metal capillary tube, and provides structural support for at least one of the electric power line, and the temperature and pressure data acquisition and transmission line.

7. The method of claim 1, wherein the production path comprises production tubing in the casing.

8. A method of removing an electric submersible pump from a well having a positive wellhead pressure, the well comprising a wellbore and a wellhead, the wellhead having a sealable injection port and at least one production port, the method comprising the steps of:

providing:

a production path in the wellbore such that production fluids flow through the production path and out the at least one production port of the wellhead;

a coiled tubing string positioned through the injection port and the production path, the coiled tubing string having an electric submersible pump at a downhole end of the coiled tubing string and at least one supply line through the coiled tubing string connected to the electric submersible pump, the electric submersible pump being sized to pass through the production path and comprising a pump section, a motor section, and a thrust chamber; and a pump-receiving housing above the wellhead and the injection port of the wellhead, the pump-receiving housing being large enough to receive the electric submersible pump, the pump-receiving housing being sealed to atmosphere when the injection port is open, and openable to atmosphere when the injection port is sealed;

using a coiled tubing injector, retracting the coiled tubing from the well with a positive well head pressure such that the electric submersible pump is withdrawn through the injection port and fully received into the pump-receiving housing, the pump-receiving housing being sealed above the electric submersible pump;

sealing the injection port below the electric submersible pump such that the electric submersible pump is sealed within the pump-receiving housing simultaneously above and below the electric submersible pump;

opening the pump-receiving housing to atmosphere; and removing the electric submersible pump from the pump-receiving housing.

9. The method of claim 8, wherein the electric submersible pump is an inverted electric submersible pump having a pump section located at a bottom end of the electric submersible pump and a motor section located at a top end of the electric submersible pump.

10. The method of claim 9, wherein the electric submersible pump comprises a thrust chamber separating the motor section and the pump section, the thrust chamber comprising mechanical seals, the clean oil supplied by the at least one supply line being ejected from the electric submersible pump via the thrust chamber.

11. The method of claim 9, wherein the pump section has inlet ports and outlet ports on an outer surface of the pump, the pump section engaging a pressure sealing seat, the pressure sealing seat sealing directly against the pump section between the inlet ports and the outlet ports such that the outlet ports are sealed within the production path and the inlet ports are sealed downhole of the production path.

12. The method of claim 8, wherein the at least one supply line comprises at least one of an oil feed line for continuously providing the electric submersible pump with clean oil and maintaining an internal positive pressure to the electric submersible pump, an electric power line, and a temperature and pressure data acquisition and transmission line.

13. The method of claim 12, wherein the oil feed line is a metal capillary tube, and provides structural support for at least one of the electric power line, and the temperature and pressure data acquisition and transmission line.

14. The method of claim 8, wherein the well comprises casing, the production path comprising production tubing positioned within the casing.

15. A method of inserting an electric submersible pump in a well with a positive wellhead pressure, the pressurized well comprising a casing and a wellhead mounted to the casing, the wellhead having a sealable injection port and at least one production port, the method comprising the steps of:

providing:

a production path in the casing such that production fluids flow through the production path and out the at least one production port of the wellhead;

a coiled tubing string having an electric submersible pump at a downhole end of the coiled tubing string and at least one supply line through the coiled tubing string connected to the electric submersible pump, the electric submersible pump being sized to pass through the production path and comprising a pump section, a motor section, and a thrust chamber; and a pump-receiving housing above the wellhead and the injection port of the wellhead, the pump-receiving housing being large enough to receive the electric submersible pump, the pump-receiving housing being sealed to atmosphere when the injection port is open, and openable to atmosphere when the injection port is sealed;

with the injection port sealed, positioning the electric submersible pump in the pump-receiving housing;

sealing the pump-receiving housing to atmosphere above the electric submersible pump such that that the electric submersible pump is sealed within the pump-receiving housing simultaneously above and below the electric submersible pump;

opening the injection port; and using a coiled tubing injector, lowering the coiled tubing and the electric submersible pump from a position fully received within the pump-receiving housing into the production path in the fluid pressurized well through the injection port of the wellhead.

16. The method of claim 15, wherein the electric submersible pump is an inverted electric submersible pump having a pump section located at a bottom end of the electric submersible pump and a motor section located at a top end of the electric submersible pump.

17. The method of claim 16, wherein lowering the electric submersible pump comprises seating the electric submersible pump in a pressure sealing seat located toward a bottom hole end of the production path that seals directly against the pump section between inlet ports and outlet ports in the pump section.

18. The method of claim 17, wherein the electric submersible pump comprises seal rings that engage the bore of the pressure sealing seat, and fluid discharge ports located directly above the seal rings.

19. The method of claim 16, wherein the at least one control line comprises at least one of an oil feed line for continuously providing the electric submersible pump with clean oil and maintaining an internal positive pressure to the electric submersible pump, an electric power line and a temperature and pressure data acquisition and transmission line.

20. The method of claim 19, wherein the electric submersible pump comprises a motor section, a pump section, and a thrust chamber separating the motor section and the pump section, the thrust chamber comprising mechanical seals, the clean oil supplied by the at least one supply line being ejected from the electric submersible pump via the thrust chamber.

21. The method of claim 19, wherein the oil feed line is a metal capillary tube, and provides structural support for at least one of the electric power line, and the temperature and pressure data acquisition and transmission line.

22. The method of claim 15, wherein the well comprises casing, the production path comprising production tubing positioned within the casing.

* * * * *